US012365435B2

(12) United States Patent
Saruwatari et al.

(10) Patent No.: US 12,365,435 B2
(45) Date of Patent: Jul. 22, 2025

(54) OUTBOARD MOTOR AND MARINE VESSEL

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 448 days.

(21) Appl. No.: 18/086,743

(22) Filed: Dec. 22, 2022

(65) Prior Publication Data

US 2023/0415875 A1 Dec. 28, 2023

(30) Foreign Application Priority Data

Jan. 13, 2022 (JP) ..... 2022-003747

(51) Int. Cl.

| | |
|---|---|
| ***B63H 20/12*** | (2006.01) |
| ***B63H 20/32*** | (2006.01) |
| ***B63H 25/02*** | (2006.01) |
| ***B63H 25/42*** | (2006.01) |
| ***B63H 25/52*** | (2006.01) |

(52) U.S. Cl.

CPC ..... *B63H 20/12* (2013.01); *B63H 20/32* (2013.01); *B63H 25/02* (2013.01); *B63H 25/42* (2013.01); *B63H 25/52* (2013.01)

(58) Field of Classification Search

CPC ..... B63H 20/12; B63H 20/32; B63H 25/02; B63H 25/42; B63H 25/52

See application file for complete search history.

(56) References Cited

U.S. PATENT DOCUMENTS

| | | | | |
|---|---|---|---|---|
| 6,546,889 | B1 * | 4/2003 | Jacob | B62D 1/166 74/498 |
| 10,800,502 | B1 | 10/2020 | Alby et al. | |
| 2005/0181687 | A1 | 8/2005 | Okumura et al. | |
| 2011/0117799 | A1 * | 5/2011 | Harada | B63H 25/20 440/58 |
| 2012/0040572 | A1 * | 2/2012 | Ooshita | B63H 20/08 440/59 |

FOREIGN PATENT DOCUMENTS

| | | | |
|---|---|---|---|
| JP | 2005-231383 | A | 9/2005 |

* cited by examiner

*Primary Examiner* — Stephen P Avila
(74) *Attorney, Agent, or Firm* — Keating & Bennett, LLP

(57) ABSTRACT

An outboard motor includes a steering mechanism switchable between a state in which a pinion is rotated by a first drive source such that an outboard motor body is steerable within a first steering angle range, and a state in which the pinion is rotated by a second drive source such that the outboard motor body is steerable within a second steering angle range different from the first steering angle range.

20 Claims, 7 Drawing Sheets

OUTBOARD MOTOR AND MARINE VESSEL

CROSS REFERENCE TO RELATED APPLICATIONS

This application claims the benefit of priority to Japanese Patent Application No. 2022-003747 filed on Jan. 13, 2022. The entire contents of this application are hereby incorporated herein by reference.

BACKGROUND OF THE INVENTION

1. Field of the Invention

The present invention relates to an outboard motor and a marine vessel, and more particularly, it relates to an outboard motor and a marine vessel each including a steering mechanism including a rotary member that rotates together with an outboard motor body and a linearly moving member that linearly moves to rotate the rotary member, and operable to rotate the outboard motor body about a steering shaft.

2. Description of the Related Art

An outboard motor including a steering mechanism including a rotary member that rotates together with an outboard motor body and a linearly moving member that linearly moves to rotate the rotary member, and operable to rotate the outboard motor body about a steering shaft is known in general. Such an outboard motor is disclosed in U.S. Pat. No. 10,800,502, for example.

U.S. Pat. No. 10,800,502 discloses an outboard motor including a steering mechanism to rotate an outboard motor body about a steering shaft. In the outboard motor disclosed in U.S. Pat. No. 10,800,502, the steering mechanism includes a rotary member (a pinion, for example) that is located in a central portion of the outboard motor body in a right-left direction and rotates together with the outboard motor body, and a linearly moving member (a rack, for example) that linearly moves along the right-left direction of the outboard motor body to rotate the rotary member.

In the outboard motor disclosed in U.S. Pat. No. 10,800,502, the linearly moving member (the rack, for example) is linearly moved to drive the rotary member (the pinion, for example), and thus when an angular range in which the outboard motor body is rotatable about the steering shaft is increased, a distance over which the linearly moving member is linearly moved is relatively increased in a direction in which the linearly moving member moves. In such a case, a relatively large space is required in the direction in which the linearly moving member moves to linearly move the linearly moving member. That is, the size of the outboard motor is increased. Therefore, it is desired to increase the angular range in which the outboard motor body is rotatable about the steering shaft while reducing or preventing an increase in the size of the outboard motor.

SUMMARY OF THE INVENTION

Preferred embodiments of the present invention provide outboard motors and marine vessels that each increase angular ranges in which outboard motor bodies are rotatable about steering shafts while reducing or preventing an increase in the sizes of (the) outboard motors.

An outboard motor according to a preferred embodiment of the present invention includes an outboard motor body, and a steering mechanism to rotate the outboard motor body about a steering shaft. The steering mechanism includes a pinion located in a central portion of the outboard motor body in a right-left direction and operable to rotate together with the outboard motor body, a rack operable to linearly move to rotate the pinion, a first drive source to drive the pinion by linearly moving the rack, a driving force transmission to transmit a driving force to the pinion, and a second drive source to drive the pinion via the driving force transmission. The steering mechanism is switchable between a state in which the pinion is rotated by the first drive source such that the outboard motor body is steerable within a first steering angle range, and a state in which the pinion is rotated by the second drive source such that the outboard motor body is steerable within a second steering angle range different from the first steering angle range.

In an outboard motor according to a preferred embodiment of the present invention, the steering mechanism is switchable between a state in which the pinion is rotated by the first drive source such that the outboard motor body is steerable within the first steering angle range, and a state in which the pinion is rotated by the second drive source such that the outboard motor body is steerable within the second steering angle range different from the first steering angle range. Accordingly, the pinion is rotated by the second drive source such that the outboard motor body is steered in an angular range different from the first steering angle range without the pinion being rotated by the first drive source. That is, when the pinion is rotated by the second drive source and transmission of a driving force between the pinion and the rack is canceled, an angular range in which the outboard motor body is rotatable about the steering shaft is increased without changing a distance over which the rack is linearly moved in a direction in which the rack moves as compared with a case in which the pinion is rotated only by the first drive source. Consequently, the angular range in which the outboard motor body is rotatable about the steering shaft is increased while an increase in the size of the outboard motor is reduced or prevented.

In an outboard motor according to a preferred embodiment of the present invention, the steering mechanism is preferably switchable between a state in which the pinion is rotated by a hydraulic actuator corresponding to the first drive source such that the outboard motor body is steerable within the first steering angle range, and a state in which the pinion is rotated by an electric motor corresponding to the second drive source such that the outboard motor body is steerable within the second steering angle range having an upper limit larger than an upper limit of the first steering angle range. When a marine vessel navigates at a relatively high speed, a relatively large load is applied to a drive source, and thus an angle at which the outboard motor body is steered is limited within a relatively small angular range. On the other hand, when the marine vessel navigates at a relatively low speed, only a relatively small load is applied to the drive source, and thus the outboard motor body may be steered at a relatively large angle. Therefore, when the marine vessel navigates at a relatively high speed, the pinion is rotated by the hydraulic actuator to steer the outboard motor body within the first steering angle range, as described above, such that a relatively large load to be applied to the drive source is easily received by a hydraulic pressure. When the marine vessel navigates at a relatively low speed, the pinion is rotated by the electric motor to steer the outboard motor body within the second steering angle range having an upper limit larger than the upper limit of the first steering angle range, as described above, such that the outboard motor body is easily steered at a relatively large angle. That is, the two drive sources are appropriately used to steer the outboard motor body.

An outboard motor according to a preferred embodiment of the present invention preferably further includes a steering controller configured or programmed to control the steering mechanism, and the steering controller is preferably configured or programmed to control the first drive source to generate a driving force from the first drive source when the pinion is rotated by the first drive source, and to control the second drive source to generate a driving force from the second drive source when the pinion is rotated by the second drive source. Accordingly, under the control of the steering controller, the steering mechanism easily switches between a state in which the pinion is rotated by the first drive source such that the outboard motor body is steerable within the first steering angle range, and a state in which the pinion is rotated by the second drive source such that the outboard motor body is steerable within the second steering angle range.

In an outboard motor according to a preferred embodiment of the present invention, the steering mechanism is preferably operable to engage the rack with the pinion when the pinion is rotated by the first drive source, and is preferably operable to not engage the rack with the pinion when the pinion is not rotated by the first drive source. Accordingly, when the pinion is rotated by the first drive source, the rack is engaged with the pinion, and thus the pinion is appropriately rotated by the first drive source. When the pinion is not rotated by the first drive source, the rack is not engaged with the pinion, and thus interference with rotation of the pinion by the second drive source due to engagement of the rack with the pinion is prevented when the pinion is rotated by the second drive source. In other words, switching between the two drive sources to steer the outboard motor body is structurally performed with ease.

In such a case, the rack preferably includes teeth to engage with the pinion, and the teeth are preferably in a predetermined range in a longitudinal direction of the rack such that the rack engages with the pinion when the pinion is rotated by the first drive source, and the rack does not engage with the pinion when the pinion is not rotated by the first drive source. Accordingly, the rack linearly moves, and thus the range in which the teeth of the rack that engage with the pinion are provided is adjusted such that the steering mechanism is easily configured such that the rack engages with the pinion when the pinion is rotated by the first drive source, and the rack does not engage with the pinion when the pinion is not rotated by the first drive source.

In an outboard motor in which the teeth of the rack that engage with the pinion are in the predetermined range in the longitudinal direction of the rack, the rack preferably includes a toothed portion on a pinion side and including the teeth to engage with the pinion when the pinion is rotated by the first drive source, and a non-toothed portion on the pinion side, adjacent to the toothed portion, and not including the teeth so as to not engage with or contact the pinion when the pinion is not rotated by the first drive source. Accordingly, a structure in which the teeth of the rack that engage with the pinion are in the predetermined range in the longitudinal direction of the rack is easily achieved.

In an outboard motor in which the rack engages with the pinion when the pinion is rotated by the first drive source and the rack does not engage with the pinion when the pinion is not rotated by the first drive source, the steering mechanism preferably further includes a rack position detector to detect a position of the rack, and a pinion position detector to detect a rotational position of the pinion. Accordingly, the rack position detector and the pinion position detector detect the position of the rack and the rotational position of the pinion, respectively, and thus when a state in which the rack does not engage with the pinion is switched to a state in which the rack engages with the pinion, the rack and the pinion are engaged with each other at a preset, predetermined position.

In an outboard motor according to a preferred embodiment of the present invention, the driving force transmission preferably includes a clutch switchable between a state in which a driving force is transmitted from an electric motor corresponding to the second drive source to the pinion when the pinion is rotated by the electric motor, and a state in which a driving force is not transmitted from the electric motor to the pinion when the pinion is not rotated by the electric motor. Accordingly, when the pinion is rotated by the electric motor, a driving force is transmitted from the electric motor to the pinion, and thus the pinion is appropriately rotated by the electric motor. When the pinion is not rotated by the electric motor, a driving force is not transmitted from the electric motor to the pinion, and thus interference with rotation of the pinion by the first drive source due to transmission of a driving force from the electric motor to the pinion is prevented when the pinion is rotated by the first drive source.

In such a case, the clutch preferably includes a first gear to be rotated by the electric motor, a second gear operable to rotate integrally with the pinion, and a switching gear operable to rotate integrally with the second gear and switchable between a state in which the switching gear engages with the first gear, and a state in which the switching gear does not engage with the first gear. Accordingly, switching between a state in which a driving force is transmitted from the electric motor to the pinion and a state in which a driving force is not transmitted from the electric motor to the pinion is easily performed by the switching gear.

In an outboard motor including the clutch including the first gear, the second gear, and the switching gear, the steering mechanism is preferably operable to engage the first gear with the switching gear while rotating the first gear with the electric motor in a state in which the rack is engaged with the pinion and linear movement of the rack by a hydraulic actuator corresponding to the first drive source is stopped to stop rotation of the switching gear when a state in which the pinion is rotated by the hydraulic actuator is switched to a state in which the pinion is rotated by the electric motor. Accordingly, when the first gear and the switching gear are engaged with each other, a hydraulic pressure reliably stops rotation of the switching gear, and thus the first gear and the switching gear are easily engaged with each other.

In an outboard motor according to a preferred embodiment of the present invention, the first steering angle range preferably has a lower limit of about 0 degrees and an upper limit of about 30 degrees or more and about 45 degrees or less, and the second steering angle range preferably has a lower limit of about 0 degrees and an upper limit set to an angle larger than the upper limit of the first steering angle range. Accordingly, the pinion is rotated by the first drive source such that the outboard motor body is steered at an angle between about 0 degrees and an angle between about 30 degrees and about 45 degrees inclusive, and the pinion is rotated by the second drive source such that the outboard motor body is steered at an angle between about 0 degrees and an angle larger than an angle between about 30 degrees and about 45 degrees inclusive.

In an outboard motor according to a preferred embodiment of the present invention, the outboard motor body preferably includes an upper portion to be attached to a hull via a bracket, and a lower portion located below the upper portion and on which a propeller is provided, and the steering mechanism is preferably operable to rotate the lower portion about the steering shaft with respect to the upper portion. Accordingly, in a structure in which the lower portion is rotated about the steering shaft with respect to the upper portion, the angular range in which the outboard motor body is rotatable about the steering shaft is increased while an increase in the size of the outboard motor body is reduced or prevented.

An outboard motor according to a preferred embodiment of the present invention includes an outboard motor body, and a steering mechanism to rotate the outboard motor body about a steering shaft. The steering mechanism includes a rotary member located in a central portion of the outboard motor body in a right-left direction and operable to rotate together with the outboard motor body, a linearly moving member operable to linearly move to rotate the rotary member, a first drive source to drive the rotary member by linearly moving the linearly moving member, a driving force transmission to transmit a driving force to the rotary member, and a second drive source to drive the rotary member via the driving force transmission. The steering mechanism is switchable between a state in which the rotary member is rotated by the first drive source such that the outboard motor body is steerable within a first steering angle range, and a state in which the rotary member is rotated by the second drive source such that the outboard motor body is steerable within a second steering angle range different from the first steering angle range.

In an outboard motor according to a preferred embodiment of the present invention, the steering mechanism is switchable between a state in which the rotary member is rotated by the first drive source such that the outboard motor body is steerable within the first steering angle range, and a state in which the rotary member is rotated by the second drive source such that the outboard motor body is steerable within the second steering angle range different from the first steering angle range. Accordingly, similarly to the outboard motors according to preferred embodiments of the present invention described above, the rotary member is rotated by the second drive source such that the outboard motor body is steered in an angular range different from the first steering angle range without the rotary member being rotated by the first drive source. That is, when the rotary member is rotated by the second drive source and transmission of a driving force between the rotary member and the linearly moving member is canceled, an angular range in which the outboard motor body is rotatable about the steering shaft is increased without changing a distance over which the linearly moving member is linearly moved in a direction in which the linearly moving member moves as compared with a case in which the rotary member is rotated only by the first drive source. Consequently, similarly to the outboard motors according to preferred embodiments of the present invention described above, the angular range in which the outboard motor body is rotatable about the steering shaft is increased while an increase in the size of the outboard motor is reduced or prevented.

An outboard motor according to a preferred embodiment of the present invention includes an outboard motor body, and a steering mechanism to rotate the outboard motor body about a steering shaft. The steering mechanism includes a rotary member located in a central portion of the outboard motor body in a right-left direction and operable to rotate together with the outboard motor body, a rack operable to linearly move to rotate the rotary member, a first drive source to drive the rotary member by linearly moving the rack, a driving force transmission to transmit a driving force to the rotary member, and a second drive source to drive the rotary member via the driving force transmission. The steering mechanism is switchable between a state in which a marine vessel is navigable within a first speed range while the rotary member is rotated by the second drive source to steer the outboard motor body, and a state in which the marine vessel is navigable within a second speed range including a speed range different from the first speed range while the rotary member is rotated by the first drive source to steer the outboard motor body.

In an outboard motor according to a preferred embodiment of the present invention, the steering mechanism is switchable between a state in which the marine vessel is navigable within the first speed range while the rotary member is rotated by the second drive source to steer the outboard motor body, and a state in which the marine vessel is navigable within the second speed range including a speed range different from the first speed range while the rotary member is rotated by the first drive source to steer the outboard motor body. As described above, when the marine vessel navigates at a relatively high speed, a relatively large load is applied to a drive source, and thus an angle at which the outboard motor body is steered is limited within a relatively small angular range. On the other hand, when the marine vessel navigates at a relatively low speed, only a relatively small load is applied to the drive source, and thus the outboard motor body may be steered at a relatively large angle. Therefore, when the marine vessel navigates at a relatively high speed and the angle at which the outboard motor body is steered is limited within a relatively small angular range, the marine vessel is only required to navigate within the first speed range while the rotary member is rotated by the second drive source to steer the outboard motor body, as described above. When the marine vessel navigates at a relatively low speed and the outboard motor body is steered at a relatively large angle, the marine vessel is only required to navigate within the second speed range including a speed range different from the first speed range while the rotary member is rotated by the first drive source to steer the outboard motor body, as described above. In such cases, the steering mechanism switches between a state in which the rotary member is rotated by the first drive source such that the outboard motor body is steerable within the first steering angle range, and a state in which the rotary member is rotated by the second drive source such that the outboard motor body is steerable within the second steering angle range different from the first steering angle range. Thus, similarly to the outboard motors according to preferred embodiments of the present invention described above, the rotary member is rotated by the second drive source such that the outboard motor body is steered in an angular range different from the first steering angle range without the rotary member being rotated by the first drive source. That is, similarly to the outboard motors according to preferred embodiments of the present invention described above, when the rotary member is rotated by the second drive source and transmission of a driving force between the rotary member and the linearly moving member is canceled, an angular range in which the outboard motor body is rotatable about the steering shaft is increased without changing a distance over which the linearly moving member is linearly moved in a direction in which the linearly moving member moves as compared with a case in which the rotary member is rotated only by the first drive source. Consequently, similarly to the outboard motors according to preferred embodiments of the present invention described above, the angular range in which the outboard motor body is rotatable about the steering shaft is increased while an increase in the size of the outboard motor is reduced or prevented.

A marine vessel according to a preferred embodiment of the present invention includes a hull, and an outboard motor attached to a stern of the hull. The outboard motor includes an outboard motor body, and a steering mechanism to rotate the outboard motor body about a steering shaft. The steering mechanism includes a pinion located in a central portion of the outboard motor body in a right-left direction and operable to rotate together with the outboard motor body, a rack operable to linearly move to rotate the pinion, a first drive source to drive the pinion by linearly moving the rack, a driving force transmission to transmit a driving force to the pinion, and a second drive source to drive the pinion via the driving force transmission. The steering mechanism is switchable between a state in which the pinion is rotated by the first drive source such that the outboard motor body is steerable within a first steering angle range, and a state in which the pinion is rotated by the second drive source such that the outboard motor body is steerable within a second steering angle range different from the first steering angle range.

In a marine vessel according to a preferred embodiment of the present invention, the steering mechanism is switchable between a state in which the pinion is rotated by the first drive source such that the outboard motor body is steerable within the first steering angle range, and a state in which the pinion is rotated by the second drive source such that the outboard motor body is steerable within the second steering angle range different from the first steering angle range. Accordingly, similarly to the outboard motors according to preferred embodiments of the present invention described above, an angular range in which the outboard motor body is rotatable about the steering shaft is increased while an increase in the size of the outboard motor is reduced or prevented.

In a marine vessel according to a preferred embodiment of the present invention, the steering mechanism is preferably switchable between a state in which the pinion is rotated by a hydraulic actuator corresponding to the first drive source such that the outboard motor body is steerable within the first steering angle range, and a state in which the pinion is rotated by an electric motor corresponding to the second drive source such that the outboard motor body is steerable within the second steering angle range having an upper limit larger than an upper limit of the first steering angle range. Accordingly, similarly to the outboard motors according to preferred embodiments of the present invention described above, the two drive sources are appropriately used.

A marine vessel according to a preferred embodiment of the present invention preferably further includes a steering controller configured or programmed to control the steering mechanism, and the steering controller is preferably configured or programmed to control the first drive source to generate a driving force from the first drive source when the pinion is rotated by the first drive source, and to control the second drive source to generate a driving force from the second drive source when the pinion is rotated by the second drive source. Accordingly, similarly to the outboard motors according to preferred embodiments of the present invention described above, the steering mechanism easily switches between a state in which the pinion is rotated by the first drive source such that the outboard motor body is steerable within the first steering angle range, and a state in which the pinion is rotated by the second drive source such that the outboard motor body is steerable within the second steering angle range.

In a marine vessel according to a preferred embodiment of the present invention, the steering mechanism is preferably operable to engage the rack with the pinion when the pinion is rotated by the first drive source, and is preferably operable to not engage the rack with the pinion when the pinion is not rotated by the first drive source. Accordingly, similarly to the outboard motors according to preferred embodiments of the present invention described above, switching between the two drive sources to steer the outboard motor body is structurally performed with ease.

In such a case, the rack preferably includes teeth to engage with the pinion, and the teeth are preferably in a predetermined range in a longitudinal direction of the rack such that the rack engages with the pinion when the pinion is rotated by the first drive source, and the rack does not engage with the pinion when the pinion is not rotated by the first drive source. Accordingly, similarly to the outboard motors according to preferred embodiments of the present invention described above, the steering mechanism is easily configured such that the rack engages with the pinion when the pinion is rotated by the first drive source, and the rack does not engage with the pinion when the pinion is not rotated by the first drive source.

In a marine vessel in which the teeth of the rack that engage with the pinion are in the predetermined range in the longitudinal direction of the rack, the rack preferably includes a toothed portion on a pinion side and including the teeth to engage with the pinion when the pinion is rotated by the first drive source, and a non-toothed portion on the pinion side, adjacent to the toothed portion, and not including the teeth so as to not engage with or contact the pinion when the pinion is not rotated by the first drive source. Accordingly, similarly to the outboard motors according to preferred embodiments of the present invention described above, a structure in which the teeth of the rack that engage with the pinion are in the predetermined range in the longitudinal direction of the rack is easily achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structures of outboard motors 100 and a marine vessel 120 according to preferred embodiments of the present invention are now described with reference to FIGS. 1 to 8. In the figures, arrow FWD represents the front of the marine vessel 120, arrow BWD represents the rear of the marine vessel 120, arrow L represents the left (port side) of the marine vessel 120, arrow R represents the right (starboard side) of the marine vessel 120, arrow Z1 represents the upper side of the marine vessel 120, and arrow Z2 represents the lower side of the marine vessel 120.

Figure 1:
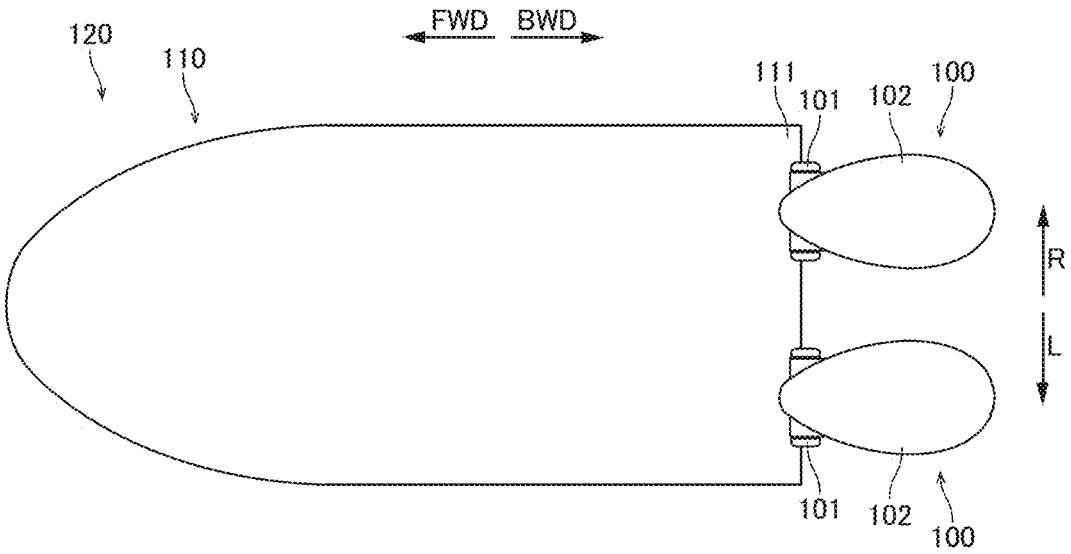
FIG. 1 is a plan view showing a marine vessel according to a preferred embodiment of the present invention.

As shown in FIG. 1, the marine vessel 120 includes a hull 110 and the outboard motors 100. The outboard motors 100 are marine propulsion devices that propel the hull 110. The outboard motors 100 are attached to a stern 111 of the hull 110. A plurality of (two in a preferred embodiment of the present invention) outboard motors 100 are attached side by side in the right-left direction of the hull 110. The marine vessel 120 may be a relatively small marine vessel used for sightseeing or fishing, for example.

Figure 2:
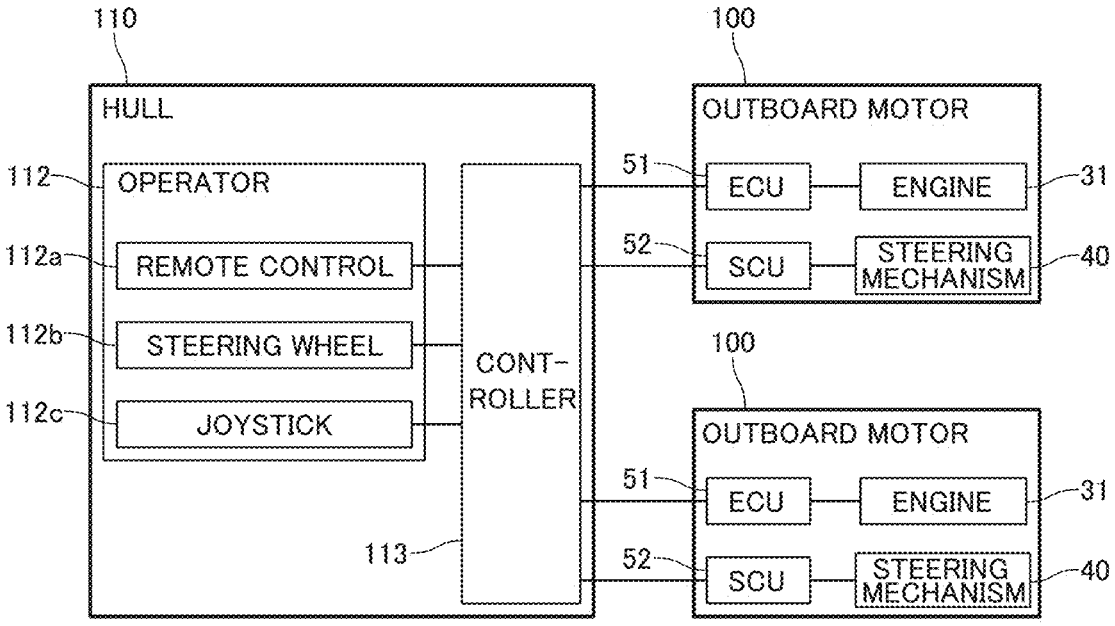
FIG. 2 is a block diagram showing the structure of a control system in a marine vessel according to a preferred embodiment of the present invention.

As shown in FIG. 2, the hull 110 includes an operator 112 to receive an operation to operate (maneuver) the marine vessel 120. The operator 112 includes a remote control 112*a*, a steering wheel 112*b*, and a joystick 112*c*.

The remote control 112*a* includes a tiltable lever. The lever of the remote control 112*a* is tilted such that the thrusts (the rotation speeds of propellers 35 (see FIG. 3)) of the outboard motors 100 are changed and/or the shift states (the forward movement states, the reverse movement states, or the neutral states) of the outboard motors 100 are switched, for example.

The steering wheel 112*b* is rotatable. The steering wheel 112*b* is rotated to steer the outboard motors 100 (change the orientations of the propellers 35 (see FIG. 3) with respect to the hull 110).

The marine vessel 120 (see FIG. 1) is translated and turned, for example, by combinations of operations on the remote control 112*a* and operations on the steering wheel 112*b*.

The joystick 112*c* includes a tiltable and rotatable lever. The lever of the joystick 112*c* is tilted, rotated, or tilted and rotated such that the thrusts of the outboard motors 100 are changed and/or the shift states of the outboard motors 100 are switched, the outboard motors 100 are steered, or the thrusts of the outboard motors 100 are changed and/or the shift states of the outboard motors 100 are switched and the outboard motors 100 are steered, for example.

The lever of the joystick 112*c* is tilted to translate the marine vessel 120 (see FIG. 1). The lever of the joystick 112*c* is tilted and rotated to turn the marine vessel 120. The lever of the joystick 112*c* is rotated to rotate the marine vessel 120.

The joystick 112*c* includes a joystick mode switch. In the marine vessel 120, the joystick mode switch is pressed to switch an operation mode between a joystick mode and a non-joystick mode. In the joystick mode, the marine vessel 120 does not receive operations on the remote control 112*a* and the steering wheel 112*b*, but receives an operation on the joystick 112*c*. In the non-joystick mode, the marine vessel 120 does not receive an operation on the joystick 112*c*, but receives operations on the remote control 112*a* and the steering wheel 112*b*.

The hull 110 includes a controller 113 to control the outboard motors 100 (engine control units (ECUs) 51, steering control units (SCUs) 52, etc. of the outboard motors 100) based on an operation on the operator 112. The controller 113 includes a central processing unit (CPU), a read-only memory (ROM), a random access memory (RAM), etc., for example. The SCU 52 is an example of a "steering controller".

Figure 3:
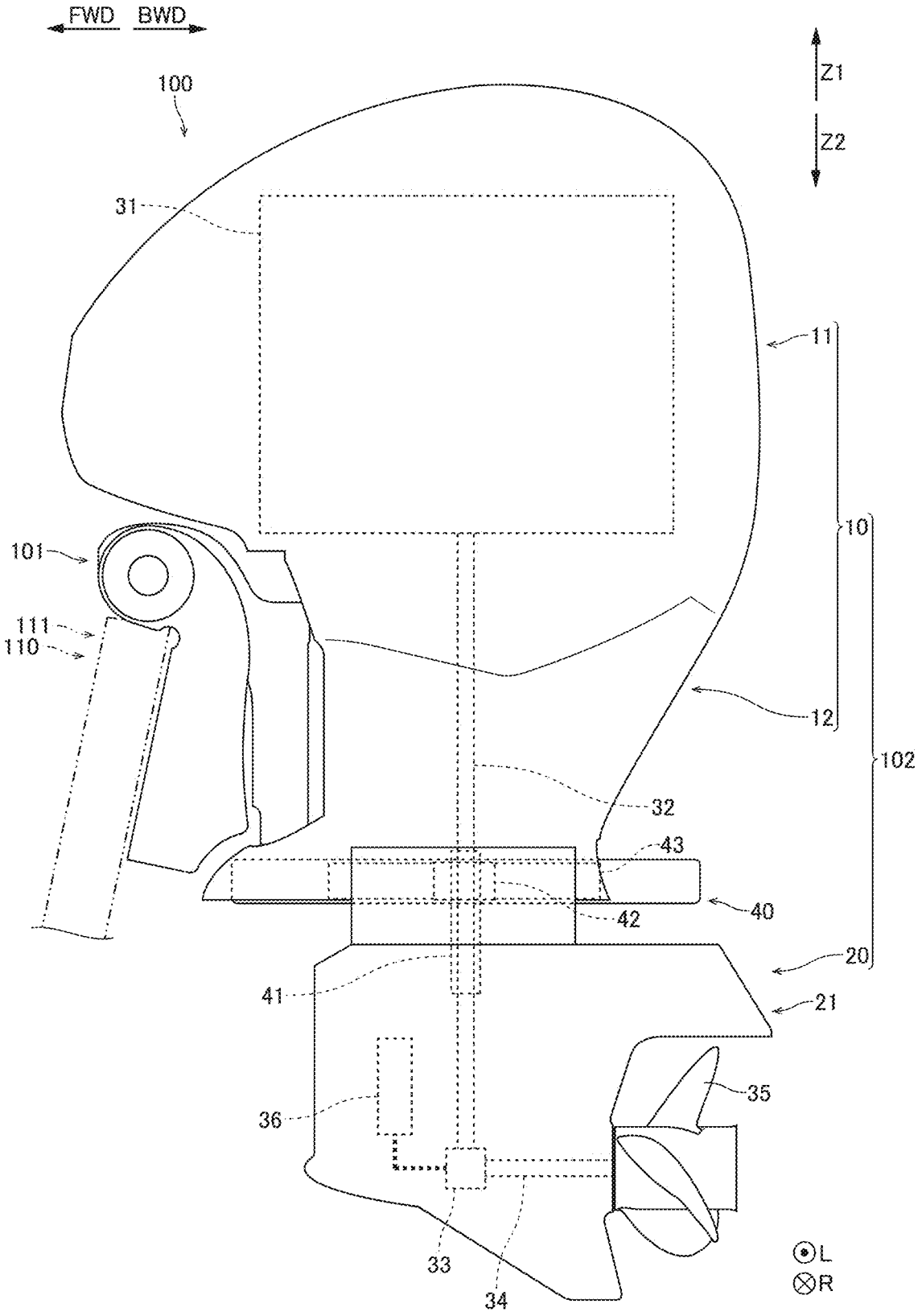
FIG. 3 is a side view showing an outboard motor according to a preferred embodiment of the present invention.

As shown in FIG. 3, each of the outboard motors 100 includes an outboard motor body 102. The outboard motor body 102 includes an upper portion 10 attached to the stern 111 of the hull 110 via a bracket 101, and a lower portion 20 located below the upper portion 10 and on which the propeller 35 is provided. The upper portion 10 includes a cowling 11 to house an engine 31, and an upper case 12 located below the cowling 11 and attached to the stern 111 of the hull 110. The lower portion 20 includes a lower case 21.

Each of the outboard motors 100 is an engine outboard motor including the engine 31 to drive the propeller 35. Specifically, the outboard motor body 102 includes the engine 31, a drive shaft 32, a gearing 33, a propeller shaft 34, and the propeller 35. The engine 31 is an internal combustion engine that generates a driving force. The drive shaft 32 extends in an upward-downward direction across the cowling 11 and the lower case 21. The drive shaft 32 is connected to a crankshaft (not shown) of the engine 31. The gearing 33 is located in the lower case 21. The gearing 33 is connected to a lower end of the drive shaft 32. The propeller shaft 34 is connected to the gearing 33. The propeller shaft 34 extends in a forward-rearward direction behind the gearing 33. The propeller 35 is connected to a rear end of the propeller shaft 34. The propeller 35 is located outside the lower case 21 to be exposed to the outside of the outboard motor body 102. A driving force is transmitted from the engine 31 to the propeller 35 via the drive shaft 32, the gearing 33, and the propeller shaft 34. The propeller 35 generates a thrust by rotating in the water by the driving force transmitted from the engine 31.

The outboard motor body 102 includes a shift actuator 36 to switch the shift state (the forward movement state, the reverse movement state, or the neutral state) of the outboard motor 100. The shift actuator 36 switches the shift state of the outboard motor 100 between the forward movement state, the backward movement state, and the neutral state by switching the meshing of the gearing 33. In the forward movement state of the outboard motor 100, a driving force is transmitted from the engine 31 to the propeller 35 to generate a forward propulsive force from the propeller 35. In the reverse movement state of the outboard motor 100, a driving force is transmitted from the engine 31 to the propeller 35 to generate a reverse propulsive force from the propeller 35. In the neutral state of the outboard motor 100, a driving force is not transmitted from the engine 31 to the propeller 35.

The outboard motor 100 includes a steering mechanism to rotate a portion of the outboard motor body 102 about a steering shaft 41. The steering mechanism 40 rotates the lower portion 20 about the steering shaft 41 with respect to the upper portion 10. That is, in the outboard motor 100, only a portion (the lower portion 20) of the outboard motor body 102 rotates with respect to the hull 110. The steering mechanism 40 is described below in detail.

As shown in FIG. 2, the outboard motor 100 includes the ECU 51 to control the engine 31 and the SCU 52 to control the steering mechanism 40. The ECU 51 controls driving of the engine 31 and driving of the shift actuator 36 based on a control by the controller 113 provided in the hull 110. The SCU 52 controls driving of the steering mechanism 40 based on a control by the controller 113. The ECU 51 and the SCU 52 include a CPU, a ROM, a RAM, etc., for example.

Figure 4:
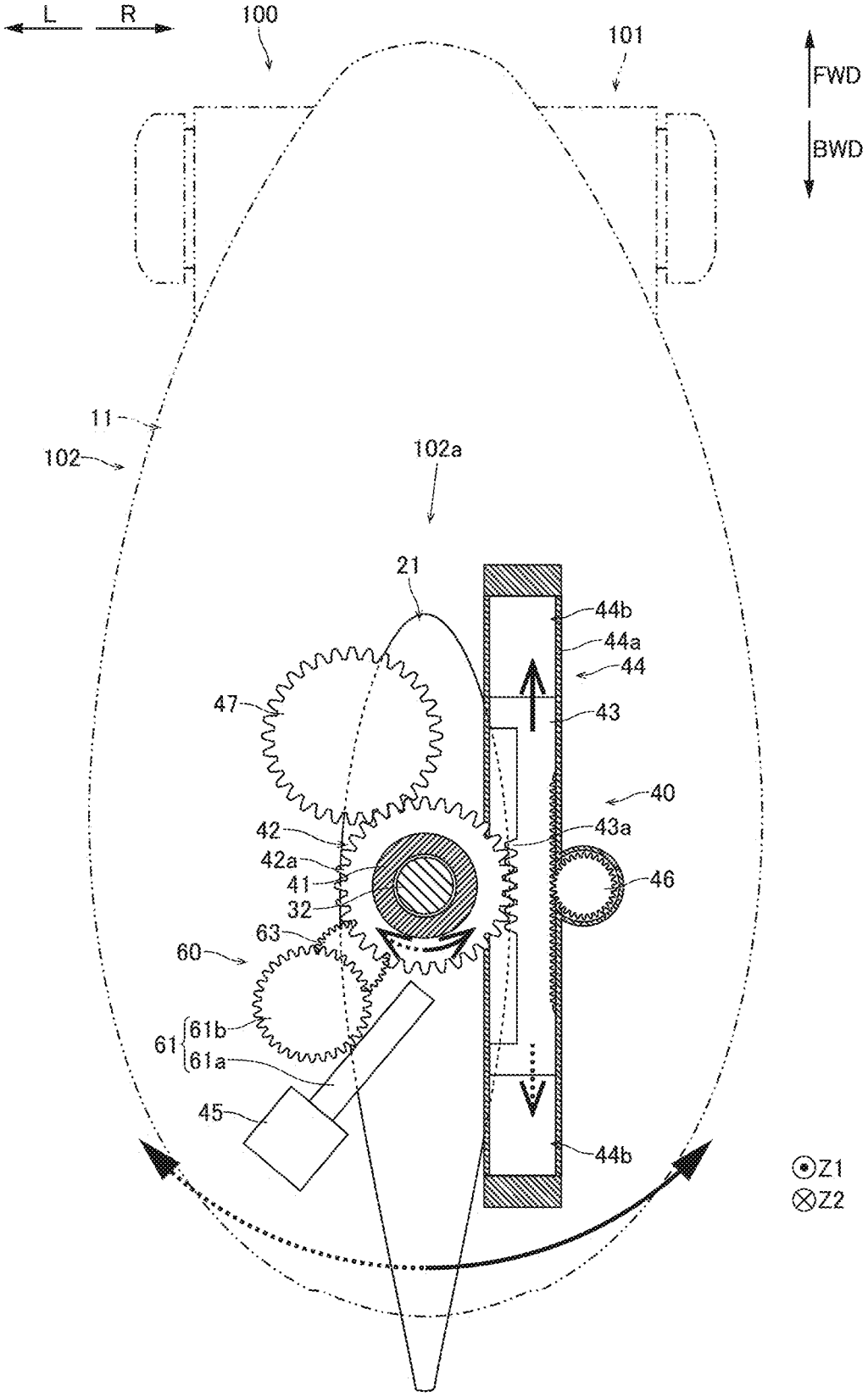
FIG. 4 is a plan view showing a steering mechanism of an outboard motor according to a preferred embodiment of the present invention.

As shown in FIG. 4, the steering mechanism 40 includes a pinion 42 that rotates together with the portion (the lower portion 20) of the outboard motor body 102. The pinion 42 is provided in a central portion 102*a* of the outboard motor body 102 in the right-left direction. The steering shaft 41 is provided inside the pinion 42. The pinion 42 is fixed to the steering shaft 41 such that the steering shaft 41 rotates as the pinion 42 rotates.

As shown in FIG. 3, the steering shaft 41 is fixed to an upper portion of the lower case 21 such that the lower case 21 rotates as the steering shaft 41 rotates. The steering shaft 41 extends in the upward-downward direction across a lower portion of the upper case 12 and the upper portion of the lower case 21. As shown in FIG. 4, the steering shaft 41 is hollow. The drive shaft 32 penetrates through a central portion of the steering shaft 41 such that the drive shaft 32 does not contact the steering shaft 41.

The steering mechanism 40 includes a rack 43 that linearly moves to rotate the pinion 42, and a hydraulic actuator 44 that linearly moves the rack 43 to drive the pinion 42. That is, the steering mechanism 40 converts linear motion into rotary motion with the rack 43 and the pinion 42. The hydraulic actuator 44 is an example of a "first drive source".

One rack 43 is provided for the pinion 42. The rack 43 is located on the starboard side of the pinion 42. The rack 43 extends along the forward-rearward direction of the outboard motor body 102. The rack 43 includes teeth 43*a* that engage with teeth 42*a* of the pinion 42. The rack 43 is linearly movable along the forward-rearward direction of the outboard motor body 102. When the rack 43 linearly moves along the forward-rearward direction of the outboard motor body 102 while the teeth 43*a* of the rack 43 engage with the teeth 42*a* of the pinion 42, the pinion 42 is rotated.

The hydraulic actuator 44 includes a hydraulic cylinder 44*a* to house the rack 43. The hydraulic cylinder 44*a* extends along the forward-rearward direction. Two oil chambers 44*b* are provided inside the hydraulic cylinder 44*a*. The two oil chambers 44*b* are provided on a first side and a second side of the rack 43 in a direction (the forward-rearward direction of the outboard motor body 102) in which the rack 43 extends. A hydraulic pump (not shown) is driven by a pump drive motor (not shown) to supply hydraulic oil to one of the two oil chambers 44*b* and to discharge hydraulic oil from the other of the two oil chambers 44*b*. The amount of hydraulic oil in the two oil chambers 44*b* is adjusted such that the rack 43 linearly moves inside the hydraulic cylinder 44*a*.

The steering mechanism 40 includes a driving force transmission mechanism 60 to transmit a driving force to the pinion 42 and an electric motor 45 to drive the pinion 42 via the driving force transmission mechanism 60. The electric motor 45 is an example of a "second drive source".

Figure 5:
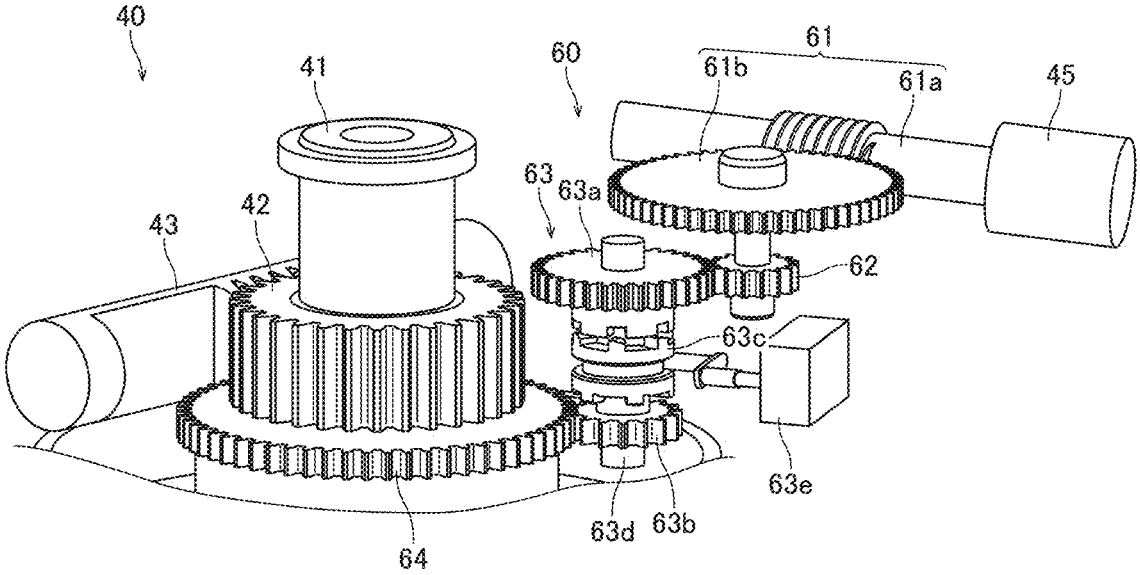
FIG. 5 is a perspective view showing a steering mechanism of an outboard motor according to a preferred embodiment of the present invention.

As shown in FIG. 5, the driving force transmission mechanism 60 includes a worm gear 61, a gear 62, a clutch 63, and a gear 64. The worm gear 61 includes a worm 61*a* that is rotated by the driving force of the electric motor 45, and a worm wheel 61*b* that engages with teeth of the worm 61*a*. In the worm gear 61, the angle of the teeth of the worm 61*a* is adjusted such that a driving force is not transmitted from the worm wheel 61*b* side to the worm 61*a* side. The gear 62 is coaxial with the worm wheel 61*b* and rotates integrally with the worm wheel 61*b*. The clutch 63 is located between the gears 62 and 64 and transmits the driving force of the electric motor 45 from the gear 62 to the gear 64. The gear 64 is coaxial with the pinion 42 and rotates integrally with the pinion 42. The clutch 63 is described below in detail.

Figure 6:
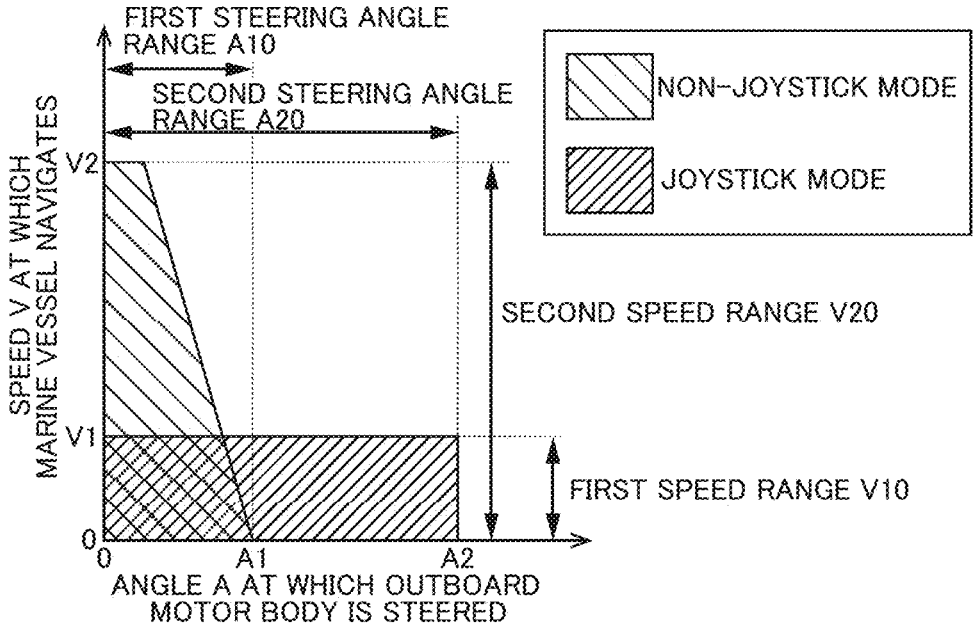
FIG. 6 is a diagram showing ranges of speeds at which a marine vessel navigates and ranges of angles at which an outboard motor body is steered when the operation mode of an outboard motor according to a preferred embodiment of the present invention is in a joystick mode and in a non-joystick mode.

As shown in FIG. 6, when the marine vessel 120 navigates at a relatively high speed V, a relatively large load is applied to a drive source, but an angle A at which the outboard motor body 102 is steered is limited within a relatively small angular range. On the other hand, when the marine vessel 120 navigates at a relatively low speed V, only a relatively small load is applied to the drive source, but the outboard motor body 102 may be steered at a relatively large angle A.

Therefore, the steering mechanism 40 (see FIG. 5) is switchable between a state in which the pinion 42 (see FIG. 4) is rotated by the hydraulic actuator 44 (see FIG. 4) such that the outboard motor body 102 (see FIG. 4) is steerable within a first steering angle range A10, and a state in which the pinion 42 is rotated by the electric motor 45 (see FIG. 4) such that the outboard motor body 102 is steerable within a second steering angle range A20 including at least an angular range different from the first steering angle range A10. Furthermore, the steering mechanism 40 is switchable between a state in which the marine vessel 120 is navigable within a first speed range V10 while the pinion 42 is rotated by the electric motor 45 to steer the outboard motor body 102, and a state in which the marine vessel 120 is navigable within a second speed range V20 including at least a speed range different from the first speed range V10 while the pinion 42 is rotated by the hydraulic actuator 44 to steer the outboard motor body 102.

Specifically, when the operation mode is in the non-joystick mode, the controller 113 (see FIG. 2) controls the engine 31 (see FIG. 2) via the ECU 51 (see FIG. 2) to adjust the speed V of the marine vessel 120 within the second speed range V20. When the operation mode is in the non-joystick mode, the controller 113 also controls the steering mechanism 40 (see FIG. 4) via the SCU 52 (see FIG. 2) to rotate the pinion 42 (see FIG. 4) with the hydraulic actuator 44 (see FIG. 4) and adjust the angle A at which the outboard motor body 102 is steered within the first steering angle range A10. That is, the SCU 52 controls the hydraulic actuator 44 to generate a driving force from the hydraulic actuator 44 when the pinion 42 is rotated by the hydraulic actuator 44.

On the other hand, when the operation mode is in the joystick mode, the controller 113 (see FIG. 2) controls the engine 31 (see FIG. 2) via the ECU 51 (see FIG. 2) to adjust the speed V of the marine vessel 120 within the first speed range V10. When the operation mode is in the joystick mode, the controller 113 also controls the steering mechanism 40 (see FIG. 4) via the SCU 52 to rotate the pinion 42 (see FIG. 4) with the electric motor 45 (see FIG. 4) and adjust the angle A at which the outboard motor body 102 is steered within the second steering angle range A20. That is, the SCU 52 controls the electric motor 45 to generate a driving force from the electric motor 45 when the pinion 42 is rotated by the electric motor 45.

The lower limit of the first speed range V10 is set to about 0 (m/s), and the upper limit thereof is set to V1 (m/s). The lower limit of the second speed range V20 is set to about 0 (m/s), and the upper limit thereof is set to V2 (m/s). The speed V1 is lower than the speed V2. The speed V2 corresponds to the maximum speed of the marine vessel 120. That is, the second speed range V20 includes the first speed range V10 and a speed range larger than the upper limit of the first speed range V10.

The lower limit of the first steering angle range A10 is set to about 0 degrees, and the upper limit thereof is set to A1. The lower limit of the second steering angle range A20 is set to about 0 degrees, and the upper limit thereof is set to A2. The angle A1 is smaller than the angle A2. The angle A1 is set to about 30 degrees or more and about 45 degrees or less. That is, the upper limit of the second steering angle range A20 is set to an angle A larger than the upper limit of the first steering angle range A10. The second steering angle range A20 includes the first steering angle range A10 and an angular range having an upper limit larger than the upper limit of the first steering angle range A10.

Figure 7:
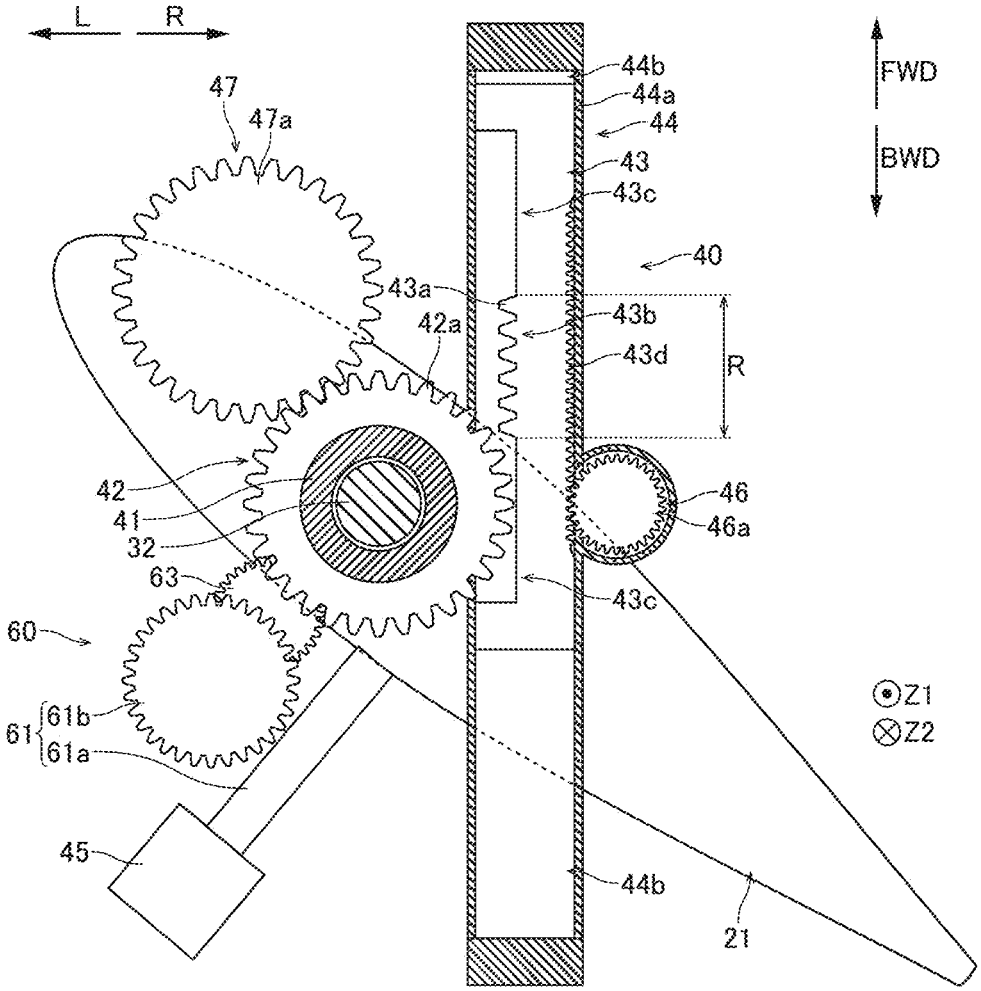
FIG. 7 is a plan view showing a state in which a rack does not engage with a pinion in a steering mechanism of an outboard motor according to a preferred embodiment of the present invention.
Figure 8:
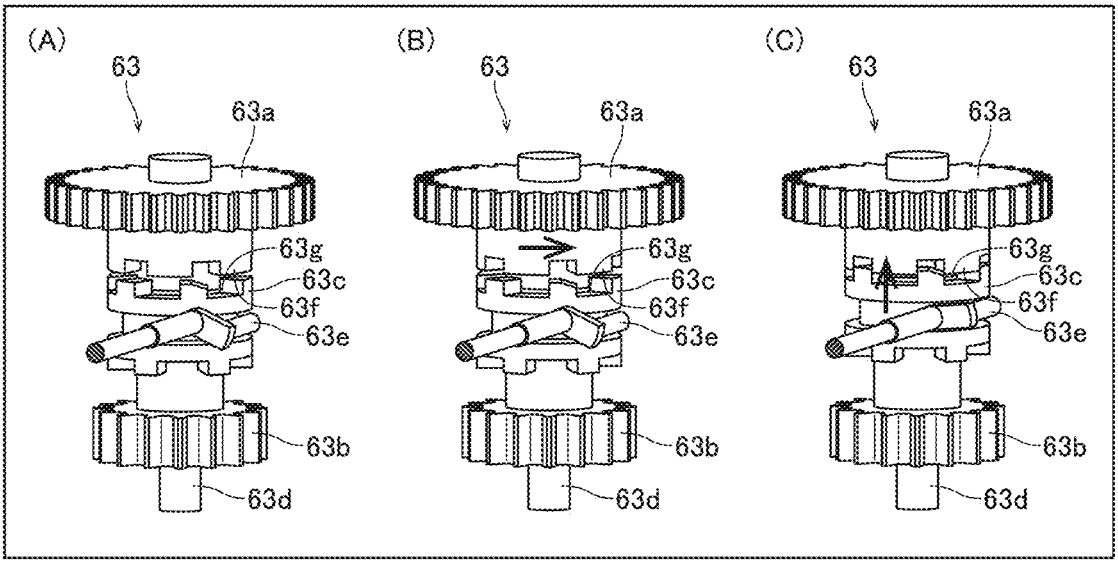
FIG. 8 is a diagram illustrating the operation of a clutch in a steering mechanism of an outboard motor according to a preferred embodiment of the present invention.

As shown in FIG. 7, when the pinion 42 is rotated by the hydraulic actuator 44, the steering mechanism 40 engages the rack 43 with the pinion 42, and when the pinion 42 is not rotated by the hydraulic actuator 44, the steering mechanism 40 does not engage the rack 43 with the pinion 42. Specifically, the teeth 43*a* of the rack 43 that engage with the pinion 42 are provided in a predetermined range R in the longitudinal direction of the rack 43 such that the rack 43 engages with the pinion 42 when the pinion 42 is rotated by the hydraulic actuator 44, and the rack 43 does not engage with the pinion 42 when the pinion 42 is not rotated by the hydraulic actuator 44. FIG. 7 shows a state in which the rack 43 does not engage with the pinion 42.

More specifically, the rack 43 includes a toothed portion 43*b* and a non-toothed portion 43*c*. The toothed portion 43*b* and the non-toothed portion 43*c* are provided on the pinion 42 side. The toothed portion 43*b* is provided in a central portion of the rack 43 in a direction in which the rack 43 linearly moves. In the toothed portion 43*b*, the teeth 43*a* are provided such that the rack 43 engages with the pinion 42 when the pinion 42 is rotated by the hydraulic actuator 44. The non-toothed portion 43*c* is provided on the opposite sides of the toothed portion 43*b* so as to be adjacent to the toothed portion 43*b* in the direction in which the rack 43 linearly moves. In the non-toothed portion 43*c*, the teeth 43*a* are not provided such that the rack 43 does not engage with or contact the pinion 42 when the pinion 42 is not rotated by the hydraulic actuator 44.

The steering mechanism 40 includes a rack position detector 46 to detect the position of the rack 43 and a pinion position detector 47 to detect the rotational position of the pinion 42. The rack position detector 46 is provided on the side opposite to the pinion 42 with respect to the rack 43. The rack position detector 46 includes a rack position detection gear 46*a* to engage with a detector-side gear portion 43*d* provided on the rack position detector 46 side of the rack 43. The rack position detector 46 detects the position of the rack 43 by detecting the rotation angle of the rack position detection gear 46*a*. The pinion position detector 47 includes a pinion position detection gear 47*a* to engage with the teeth 42*a* of the pinion 42. The pinion position detector 47 detects the rotational position of the pinion 42 by detecting the rotation angle of the pinion position detection gear 47*a*.

As shown in FIG. 5, the clutch 63 is switchable between a state in which a driving force is transmitted from the electric motor 45 to the pinion 42 when the pinion 42 is rotated by the electric motor 45, and a state in which a driving force is not transmitted from the electric motor 45 to the pinion 42 when the pinion 42 is not rotated by the electric motor 45. Specifically, the clutch 63 includes a first gear 63*a* rotated by the electric motor 45, a second gear 63*b* that rotates integrally with the pinion 42, and a switching gear 63*c* that rotates integrally with the second gear 63*b* and is switchable between a state in which the switching gear 63*c* engages with the first gear 63*a* and a state in which the switching gear 63*c* does not engage with the first gear 63*a*.

More specifically, the upper portion of the first gear 63*a* engages with the gear 62. The second gear 63*b* engages with the gear 64. The first gear 63*a*, the second gear 63*b*, and the switching gear 63*c* rotate about a rotation shaft 63*d*. The second gear 63*b* and the switching gear 63*c* always rotate integrally with the rotation shaft 63*d*. The switching gear 63*c* is slid in the upward-downward direction by a clutch actuator 63*e*. When the switching gear 63*c* is slid upward and engages with a lower portion of the first gear 63*a*, the switching gear 63*c* rotates as the first gear 63*a* rotates. That is, a driving force is transmitted from the electric motor 45 to the pinion 42. On the other hand, when the switching gear 63*c* is slid downward and does not engage with the lower portion of the first gear 63*a*, the switching gear 63*c* does not rotate even when the first gear 63*a* rotates. That is, a driving force is not transmitted from the electric motor 45 to the pinion 42. FIG. 5 shows a state in which the switching gear 63*c* does not engage with the lower portion of the first gear 63*a*.

The steering mechanism 40 engages the first gear 63*a* with the switching gear 63*c* while rotating the first gear 63*a* with the electric motor 45 in a state in which the rack 43 is engaged with the pinion 42 and linear movement of the rack 43 by the hydraulic actuator 44 is stopped to stop rotation of the switching gear 63*c* when a state in which the pinion 42 is rotated by the hydraulic actuator 44 (see FIG. 4) is switched to a state in which the pinion 42 is rotated by the electric motor 45. Specifically, as shown in FIG. 8A, when the pinion 42 is rotated by the hydraulic actuator 44, the positions of engagement teeth 63*f* of the lower portion of the first gear 63*a* and the positions of engagement teeth 63*g* of the switching gear 63*c* may be misaligned in a rotational direction. In such a case, first, the rack 43 is engaged with the pinion 42, and linear movement of the rack 43 by the hydraulic actuator 44 is stopped while the electric motor 45 is not driven. That is, rotation of the switching gear 63*c* is stopped. Then, as shown in FIG. 8B, the first gear 63*a* is rotated by the electric motor 45 such that the positions of the engagement teeth 63*f* of the lower portion of the first gear 63*a* and the positions of the engagement teeth 63*g* of the switching gear 63*c* are aligned in the rotational direction. Then, as shown in FIG. 8C, the switching gear 63*c* is slid upward by the clutch actuator 63*e* while the positions of the engagement teeth 63*f* of the lower portion of the first gear 63*a* and the positions of the engagement teeth 63*g* of the switching gear 63*c* are aligned in the rotational direction such that the switching gear 63*c* is engaged with the lower portion of the first gear 63*a*.

According to the various preferred embodiments of the present invention described above, the following advantageous effects are achieved.

According to a preferred embodiment of the present invention, the steering mechanism 40 is switchable between a state in which the pinion 42 is rotated by the hydraulic actuator 44 such that the outboard motor body 102 is steerable within the first steering angle range, and a state in which the pinion 42 is rotated by the electric motor 45 such that the outboard motor body 102 is steerable within the second steering angle range A20 including at least an angular range different from the first steering angle range A10. Accordingly, the pinion 42 is rotated by the electric motor 45 such that the outboard motor body 102 is steered in the angular range different from the first steering angle range A10 without the pinion 42 being rotated by the hydraulic actuator 44. That is, when the pinion 42 is rotated by the electric motor 45 and transmission of a driving force between the pinion 42 and the rack 43 is canceled, the angular range in which the outboard motor body 102 is rotatable about the steering shaft 41 is increased without changing a distance over which the rack 43 is linearly moved in the direction in which the rack 43 moves as compared with a case in which the pinion 42 is rotated only by the hydraulic actuator 44. Consequently, the angular range in which the outboard motor body 102 is rotatable about the steering shaft 41 is increased while an increase in the size of the outboard motor 100 is reduced or prevented.

According to a preferred embodiment of the present invention, the steering mechanism 40 is switchable between a state in which the marine vessel 120 is navigable within the first speed range V10 while the pinion 42 is rotated by the electric motor 45 to steer the outboard motor body 102, and a state in which the marine vessel 120 is navigable within the second speed range V20 including at least a speed range different from the first speed range V10 while the pinion 42 is rotated by the hydraulic actuator 44 to steer the outboard motor body 102. Accordingly, when the marine vessel 120 navigates at a relatively high speed V and the angle A at which the outboard motor body 102 is steered is limited within a relatively small angular range, the marine vessel 120 is only required to navigate within the first speed range V10 while the pinion 42 is rotated by the electric motor 45 to steer the outboard motor body 102, as described above. When the marine vessel 120 navigates at a relatively low speed V and the outboard motor body 102 is steered at a relatively large angle A, the marine vessel 120 is only required to navigate within the second speed range V20 including at least a speed range different from the first speed range V10 while the pinion 42 is rotated by the hydraulic actuator 44 to steer the outboard motor body 102, as described above. In such cases, the steering mechanism 40 switches between a state in which the pinion 42 is rotated by the hydraulic actuator 44 such that the outboard motor body 102 is steerable within the first steering angle range A10, and a state in which the pinion 42 is rotated by the electric motor 45 such that the outboard motor body 102 is steerable within the second steering angle range A20 including at least an angular range different from the first steering angle range A10. Thus, as described above, the pinion 42 is rotated by the electric motor 45 such that the outboard motor body 102 is steered in an angular range different from the first steering angle range A10 without the pinion 42 being rotated by the hydraulic actuator 44. That is, when the pinion 42 is rotated by the electric motor and transmission of a driving force between the pinion 42 and the rack 43 is canceled, the angular range in which the outboard motor body 102 is rotatable about the steering shaft 41 is increased without changing a distance over which the rack 43 is linearly moved in the direction in which the rack 43 moves as compared with a case in which the pinion 42 is rotated only by the hydraulic actuator 44. Consequently, as described above, the angular range in which the outboard motor body 102 is rotatable about the steering shaft 41 is increased while an increase in the size of the outboard motor 100 is reduced or prevented.

According to a preferred embodiment of the present invention, the steering mechanism 40 is switchable between a state in which the pinion 42 is rotated by the hydraulic actuator 44 such that the outboard motor body 102 is steerable within the first steering angle range A10, and a state in which the pinion 42 is rotated by the electric motor 45 such that the outboard motor body 102 is steerable within the second steering angle range A20 having an angular range including an upper limit larger than the upper limit of the first steering angle range A10. Accordingly, when the marine vessel 120 navigates at a relatively high speed V, the pinion 42 is rotated by the hydraulic actuator 44 to steer the outboard motor body 102 within the first steering angle range A10, as described above, such that a relatively large load to be applied to the drive source is easily received by a hydraulic pressure. When the marine vessel 120 navigates at a relatively low speed V, the pinion 42 is rotated by the electric motor 45 to steer the outboard motor body 102 within the second steering angle range A20 having an angular range including an upper limit larger than the upper limit of the first steering angle range A10, as described above, such that the outboard motor body 102 is easily steered at a relatively large angle A. That is, the two drive sources are appropriately used to steer the outboard motor body 102.

According to a preferred embodiment of the present invention, the outboard motor 100 includes the SCU 52 configured or programmed to control the steering mechanism 40. The SCU 52 is configured or programmed to control the hydraulic actuator 44 to generate a driving force from the hydraulic actuator 44 when the pinion 42 is rotated by the hydraulic actuator 44, and to control the electric motor 45 to generate a driving force from the electric motor 45 when the pinion 42 is rotated by the electric motor 45. Accordingly, under the control of the SCU 52, the steering mechanism 40 easily switches between a state in which the pinion 42 is rotated by the hydraulic actuator 44 such that the outboard motor body 102 is steerable within the first steering angle range A10, and a state in which the pinion 42 is rotated by the electric motor 45 such that the outboard motor body 102 is steerable within the second steering angle range A20.

According to a preferred embodiment of the present invention, the steering mechanism 40 is operable to engage the rack 43 with the pinion 42 when the pinion 42 is rotated by the hydraulic actuator 44, and is operable to not engage the rack 43 with the pinion 42 when the pinion 42 is not rotated by the hydraulic actuator 44. Accordingly, when the pinion 42 is rotated by the hydraulic actuator 44, the rack 43 is engaged with the pinion 42, and thus the pinion 42 is appropriately rotated by the hydraulic actuator 44. When the pinion 42 is not rotated by the hydraulic actuator 44, the rack 43 is not engaged with the pinion 42, and thus interference with rotation of the pinion 42 by the electric motor 45 due to engagement of the rack 43 with the pinion 42 is prevented when the pinion 42 is rotated by the electric motor 45. In other words, switching between the two drive sources to steer the outboard motor body 102 is structurally performed with ease.

According to a preferred embodiment of the present invention, the teeth 43*a* of the rack 43 that engage with the pinion 42 are provided in the predetermined range R in the longitudinal direction of the rack 43 such that the rack 43 engages with the pinion 42 when the pinion 42 is rotated by the hydraulic actuator 44, and the rack 43 does not engage with the pinion 42 when the pinion 42 is not rotated by the hydraulic actuator 44. Accordingly, the rack 43 linearly moves, and thus the range in which the teeth 43*a* of the rack 43 that engage with the pinion 42 are provided is adjusted such that the steering mechanism 40 is easily configured such that the rack 43 engages with the pinion 42 when the pinion 42 is rotated by the hydraulic actuator 44, and the rack 43 does not engage with the pinion 42 when the pinion 42 is not rotated by the hydraulic actuator 44.

According to a preferred embodiment of the present invention, the rack 43 includes the toothed portion 43*b* provided on the pinion 42 side and including the teeth 43*a* to engage with the pinion 42 when the pinion 42 is rotated by the hydraulic actuator 44, and the non-toothed portion 43*c* provided on the pinion 42 side, adjacent to the toothed portion 43*b*, and not including the teeth 43*a* so as to not engage with or contact the pinion 42 when the pinion 42 is not rotated by the hydraulic actuator 44. Accordingly, a structure in which the teeth 43*a* of the rack 43 that engage with the pinion 42 are provided in the predetermined range R in the longitudinal direction of the rack 43 is easily achieved.

According to a preferred embodiment of the present invention, the steering mechanism 40 includes the rack position detector 46 to detect the position of the rack 43, and the pinion position detector 47 to detect the rotational position of the pinion 42. Accordingly, the rack position detector 46 and the pinion position detector 47 detect the position of the rack 43 and the rotational position of the pinion 42, respectively, and thus when a state in which the rack 43 does not engage with the pinion 42 is switched to a state in which the rack 43 engages with the pinion 42, the rack 43 and the pinion 42 are engaged with each other at a preset, predetermined position.

According to a preferred embodiment of the present invention, the driving force transmission mechanism 60 includes the clutch 63 switchable between a state in which a driving force is transmitted from the electric motor 45 to the pinion 42 when the pinion 42 is rotated by the electric motor 45, and a state in which a driving force is not transmitted from the electric motor 45 to the pinion 42 when the pinion 42 is not rotated by the electric motor 45. Accordingly, when the pinion 42 is rotated by the electric motor 45, a driving force is transmitted from the electric motor 45 to the pinion 42, and thus the pinion 42 is appropriately rotated by the electric motor 45. When the pinion 42 is not rotated by the electric motor 45, a driving force is not transmitted from the electric motor 45 to the pinion 42, and thus interference with rotation of the pinion 42 by the hydraulic actuator 44 due to transmission of a driving force from the electric motor 45 to the pinion 42 is prevented when the pinion 42 is rotated by the hydraulic actuator 44.

According to a preferred embodiment of the present invention, the clutch 63 includes the first gear 63*a* rotated by the electric motor 45, the second gear 63*b* operable to rotate integrally with the pinion 42, and the switching gear 63*c* operable to rotate integrally with the second gear 63*b* and switchable between a state in which the switching gear 63*c* engages with the first gear 63*a* and a state in which the switching gear 63*c* does not engage with the first gear 63*a*. Accordingly, switching between a state in which a driving force is transmitted from the electric motor 45 to the pinion 42 and a state in which a driving force is not transmitted from the electric motor 45 to the pinion 42 is easily performed by the switching gear 63*c*.

According to a preferred embodiment of the present invention, the steering mechanism 40 is operable to engage the first gear 63*a* with the switching gear 63*c* while rotating the first gear 63*a* with the electric motor 45 in a state in which the rack 43 is engaged with the pinion 42 and linear movement of the rack 43 by the hydraulic actuator 44 is stopped to stop rotation of the switching gear 63*c* when a state in which the pinion 42 is rotated by the hydraulic actuator 44 is switched to a state in which the pinion 42 is rotated by the electric motor Accordingly, when the first gear 63*a* and the switching gear 63*c* are engaged with each other, a hydraulic pressure reliably stops rotation of the switching gear 63*c*, and thus the first gear 63*a* and the switching gear 63*c* are easily engaged with each other.

According to a preferred embodiment of the present invention, the first steering angle range A10 has a lower limit of about 0 degrees and an upper limit of about 30 degrees or more and about 45 degrees or less, and the second steering angle range A20 has a lower limit of about 0 degrees and an upper limit set to an angle A larger than the upper limit of the first steering angle range A10. Accordingly, the pinion 42 is rotated by the hydraulic actuator 44 such that the outboard motor body 102 is steered at an angle A between about 0 degrees and an angle between about 30 degrees and about 45 degrees inclusive, and the pinion 42 is rotated by the electric motor 45 such that the outboard motor body 102 is steered at an angle A between about 0 degrees and an angle larger than an angle between about degrees and about 45 degrees inclusive.

According to a preferred embodiment of the present invention, the outboard motor body 102 includes the upper portion 10 attached to the hull 110 via the bracket 101, and a lower portion 20 located below the upper portion 10 and on which the propeller 35 is provided. Furthermore, the steering mechanism 40 is operable to rotate the lower portion 20 about the steering shaft 41 with respect to the upper portion 10. Accordingly, in a structure in which the lower portion 20 is rotated about the steering shaft 41 with respect to the upper portion 10, the angular range in which the outboard motor body 102 is rotatable about the steering shaft 41 is increased while an increase in the size of the outboard motor body 100 is reduced or prevented.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the steering mechanism 40 preferably rotates the lower portion 20 about the steering shaft 41 with respect to the upper portion 10 in preferred embodiments described above, the present invention is not restricted to this. In a preferred embodiment of the present invention, the steering mechanism may alternatively rotate the entire outboard motor body about the steering shaft with respect to the hull.

While the upper limit of the first steering angle range A10 is preferably about 30 degrees or more and about 45 degrees or less in preferred embodiments described above, the present invention is not restricted to this. In a preferred embodiment of the present invention, the upper limit of the first steering angle range may alternatively be less than about degrees or more than about 45 degrees.

While the steering mechanism 40 preferably engages the first gear 63*a* with the switching gear 63*c* while rotating the first gear 63*a* with the electric motor 45 in a state in which the rack 43 is engaged with the pinion 42 and linear movement of the rack 43 by the hydraulic actuator 44 is stopped to stop rotation of the switching gear 63*c* when a state in which the pinion 42 is rotated by the hydraulic actuator 44 is switched to a state in which the pinion 42 is rotated by the electric motor in preferred embodiments described above, the present invention is not restricted to this. In a preferred embodiment of the present invention, the steering mechanism may alternatively engage the first gear with the switching gear while rotating the first gear with the electric motor in a state in which the rack is not engaged with the pinion when a state in which the pinion is rotated by the hydraulic actuator is switched to a state in which the pinion is rotated by the electric motor. Alternatively, the steering mechanism may engage the first gear with the switching gear while rotating the first gear with the electric motor in a state in which the rack is engaged with the pinion and the rack is linearly moved by the hydraulic actuator to rotate the switching gear when a state in which the pinion is rotated by the hydraulic actuator is switched to a state in which the pinion is rotated by the electric motor.

While the clutch 63 preferably includes the first gear 63*a* rotated by the electric motor 45, the second gear 63*b* operable to rotate integrally with the pinion 42, and the switching gear 63*c* operable to rotate integrally with the second gear 63*b* and switchable between a state in which the switching gear 63*c* engages with the first gear 63*a* and a state in which the switching gear 63*c* does not engage with the first gear 63*a* in preferred embodiments described above, the present invention is not restricted to this. In a preferred embodiment of the present invention, as long as switching between a state in which a driving force is transmitted from the electric motor to the pinion and a state in which a driving force is not transmitted from the electric motor to the pinion is possible, the clutch may have a structure other than a structure including the first gear, the second gear, and the switching gear.

While the hydraulic actuator 44 and the electric motor 45 preferably correspond to the "first drive source" and the "second drive source", respectively, in preferred embodiments described above, the present invention is not restricted to this. In a preferred embodiment of the present invention, a drive source other than the hydraulic actuator may alternatively correspond to the "first drive source", or a drive source other than the electric motor may alternatively correspond to the "second drive source".

While the second steering angle range A20 preferably includes an angular range having an upper limit larger than the upper limit of the first steering angle range A10 in preferred embodiments described above, the present invention is not restricted to this. In a preferred embodiment of the present invention, the second steering angle range may not include an angular range having an upper limit larger than the upper limit of the first steering angle range. That is, the second steering angle range may have a lower limit smaller than the lower limit of the first steering angle range.

While one rack 43 is preferably provided for the pinion 42 in preferred embodiments described above, the present invention is not restricted to this. In a preferred embodiment of the present invention, a plurality of racks may alternatively be provided for the pinion.

While the rack 43 is preferably located on the starboard side of the pinion 42 in preferred embodiments described above, the present invention is not restricted to this. In a preferred embodiment of the present invention, the rack may alternatively be located on the port side of the pinion.

Figure 9:
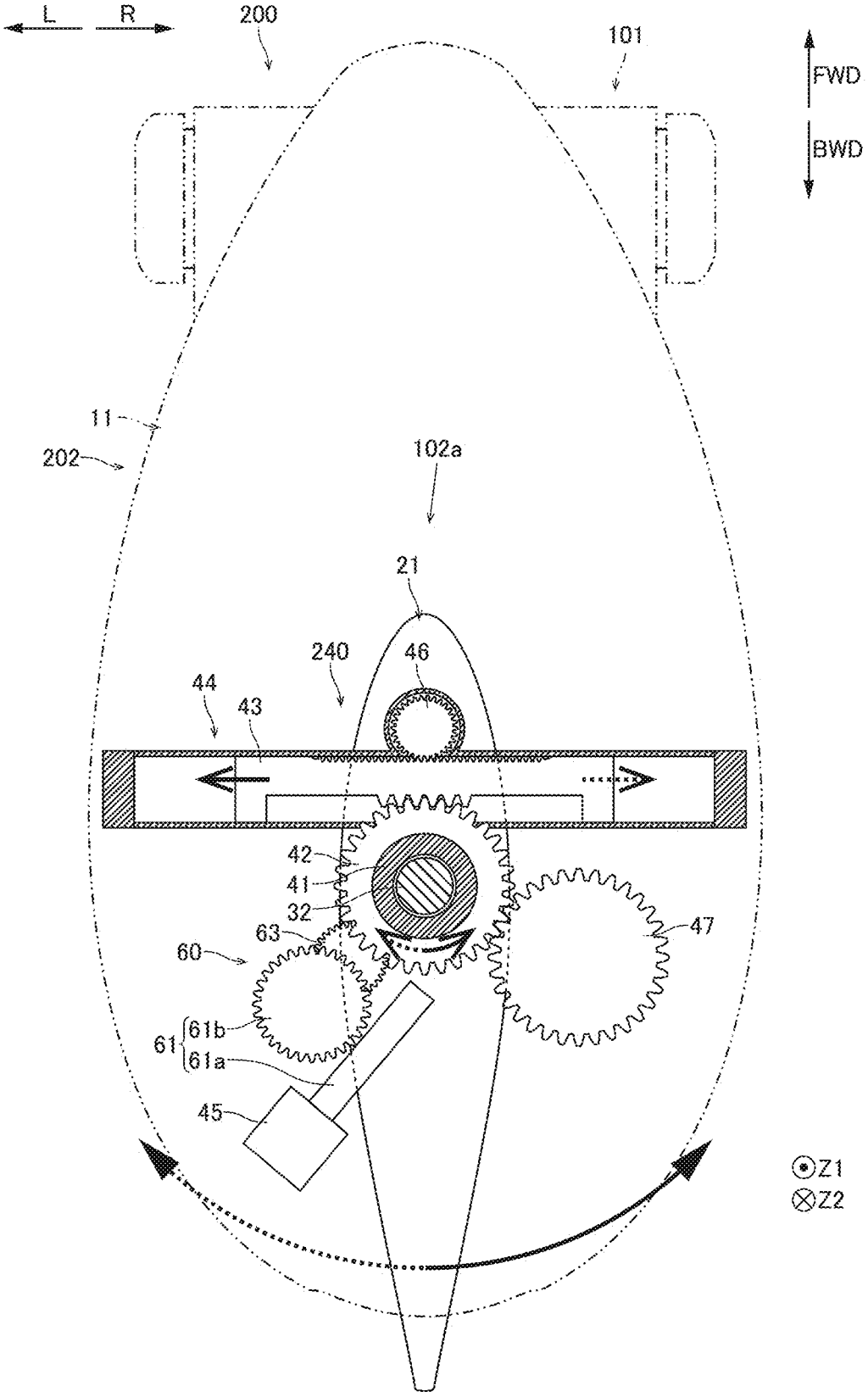
FIG. 9 is a plan view showing a steering mechanism of an outboard motor according to a first modified example of a preferred embodiment of the present invention.

While the rack 43 preferably extends along the forward-rearward direction of the outboard motor body 102 in preferred embodiments described above, the present invention is not restricted to this. In a preferred embodiment of the present invention, as in a first modified example shown in FIG. 9, a rack may alternatively extend along the right-left direction of an outboard motor body. As shown in FIG. 9, an outboard motor 200 according to the first modified example includes an outboard motor body 202 and a steering mechanism 240. In the steering mechanism 240, a rack 43 extends along the right-left direction of the outboard motor body 202. Although FIG. 9 shows an example in which the rack 43 is located on the front side of a pinion 42, the rack 43 may be located on the rear side of the pinion 42.

While the plurality of outboard motors 100 are preferably attached to the stern 111 of the hull 110 so as to be aligned in the right-left direction of the hull 110 in preferred embodiments described above, the present invention is not restricted to this. In a preferred embodiment of the present invention, only one outboard motor may alternatively be attached to the stern of the hull.

Figure 10:
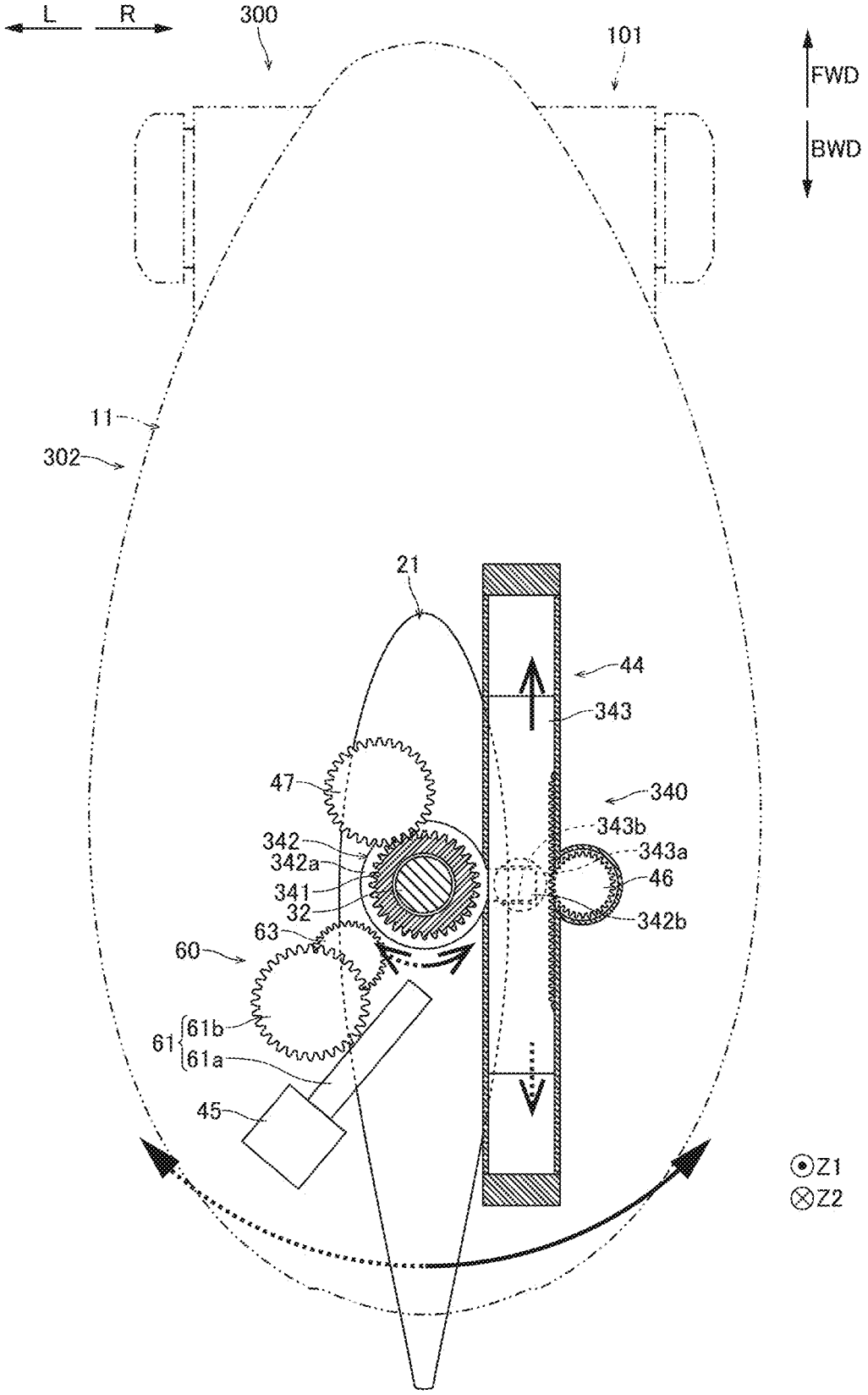
FIG. 10 is a plan view showing a steering mechanism of an outboard motor according to a second modified example of a preferred embodiment of the present invention.

While the steering mechanism 40 preferably converts linear motion into rotary motion with the rack 43 and the pinion 42 in preferred embodiments described above, the present invention is not restricted to this. In a preferred embodiment of the present invention, as in a second modified example shown in FIG. 10, a steering mechanism may alternatively convert linear motion into rotary motion with components other than a rack and a pinion. As shown in FIG. 10, an outboard motor 300 according to the second modified example includes an outboard motor body 302 and a steering mechanism 340 to rotate the outboard motor body 302 about a steering shaft 341. The steering mechanism 340 includes a link member 342 that rotates together with the outboard motor body 302, and a piston 343 that linearly moves to rotate the link member 342. Specifically, the link member 342 includes a cylindrical portion 342*a* that surrounds the steering shaft 341, and an arm 342*b* extending from the cylindrical portion 342*a* toward the piston 343. The cylindrical portion 342*a* is fixed to the steering shaft 341 by spline engagement such that the steering shaft 341 rotates as the cylindrical portion 342*a* rotates. The piston 343 is located in a central portion of the piston 343 in the forward-rearward direction of the outboard motor body 302, and includes a rotor 343*a* that is rotatable with respect to the piston 343. The arm 342*b* is fixed to the piston 343 by being fitted into a hole 343*b* of the rotor 343*a* of the piston 343. When the piston 343 is linearly moved in the forward-rearward direction of the outboard motor body 302, the position of the arm 342*b* with respect to the steering shaft 341 changes while the rotor 343*a* of the piston 343 rotates. As the position of the arm 342*b* with respect to the steering shaft 341 changes, the cylindrical portion 342*a* fixed to the steering shaft 341 rotates. The link member 342 and the piston 343 are examples of a "rotary member" and a "linearly moving member", respectively.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor body; and a steering mechanism to rotate the outboard motor body about a steering shaft; wherein the steering mechanism includes:

a pinion located in a central portion of the outboard motor body in a right-left direction and operable to rotate together with the outboard motor body;

a rack operable to linearly move to rotate the pinion;

a first drive source to drive the pinion by linearly moving the rack;

a driving force transmission to transmit a driving force to the pinion; and a second drive source to drive the pinion via the driving force transmission; and the steering mechanism is switchable between a state in which the pinion is rotated by the first drive source such that the outboard motor body is steerable within a first steering angle range, and a state in which the pinion is rotated by the second drive source such that the outboard motor body is steerable within a second steering angle range different from the first steering angle range.

2. The outboard motor according to claim 1, wherein the steering mechanism is switchable between a state in which the pinion is rotated by a hydraulic actuator corresponding to the first drive source such that the outboard motor body is steerable within the first steering angle range, and a state in which the pinion is rotated by an electric motor corresponding to the second drive source such that the outboard motor body is steerable within the second steering angle range having an upper limit larger than an upper limit of the first steering angle range.

3. The outboard motor according to claim 1, further comprising:

a steering controller configured or programmed to control the steering mechanism; wherein the steering controller is configured or programmed to control the first drive source to generate a driving force from the first drive source when the pinion is rotated by the first drive source, and to control the second drive source to generate a driving force from the second drive source when the pinion is rotated by the second drive source.

4. The outboard motor according to claim 1, wherein the steering mechanism is operable to engage the rack with the pinion when the pinion is rotated by the first drive source, and is operable to not engage the rack with the pinion when the pinion is not rotated by the first drive source.

5. The outboard motor according to claim 4, wherein the rack includes teeth to engage with the pinion; and the teeth are in a predetermined range in a longitudinal direction of the rack such that the rack engages with the pinion when the pinion is rotated by the first drive source, and the rack does not engage with the pinion when the pinion is not rotated by the first drive source.

6. The outboard motor according to claim 5, wherein the rack includes:

a toothed portion on a pinion side and including the teeth to engage with the pinion when the pinion is rotated by the first drive source; and a non-toothed portion on the pinion side, adjacent to the toothed portion, and not including the teeth so as to not engage with or contact the pinion when the pinion is not rotated by the first drive source.

7. The outboard motor according to claim 4, wherein the steering mechanism further includes:

a rack position detector to detect a position of the rack; and a pinion position detector to detect a rotational position of the pinion.

8. The outboard motor according to claim 1, wherein the driving force transmission includes a clutch switchable between a state in which a driving force is transmitted from an electric motor corresponding to the second drive source to the pinion when the pinion is rotated by the electric motor, and a state in which a driving force is not transmitted from the electric motor to the pinion when the pinion is not rotated by the electric motor.

9. The outboard motor according to claim 8, wherein the clutch includes:

a first gear to be rotated by the electric motor;

a second gear operable to rotate integrally with the pinion; and a switching gear operable to rotate integrally with the second gear and switchable between a state in which the switching gear engages with the first gear and a state in which the switching gear does not engage with the first gear.

10. The outboard motor according to claim 9, wherein the steering mechanism is operable to engage the first gear with the switching gear while rotating the first gear with the electric motor in a state in which the rack is engaged with the pinion and linear movement of the rack by a hydraulic actuator corresponding to the first drive source is stopped to stop rotation of the switching gear when a state in which the pinion is rotated by the hydraulic actuator is switched to a state in which the pinion is rotated by the electric motor.

11. The outboard motor according to claim 1, wherein the first steering angle range has a lower limit of about 0 degrees and an upper limit of about 30 degrees or more and about 45 degrees or less; and the second steering angle range has a lower limit of about 0 degrees and an upper limit set to an angle larger than the upper limit of the first steering angle range.

12. The outboard motor according to claim 1, wherein the outboard motor body includes:

an upper portion to be attached to a hull via a bracket; and a lower portion located below the upper portion and on which a propeller is provided; and the steering mechanism is operable to rotate the lower portion about the steering shaft with respect to the upper portion.

13. An outboard motor comprising:

an outboard motor body; and a steering mechanism to rotate the outboard motor body about a steering shaft; wherein the steering mechanism includes:

a rotary member located in a central portion of the outboard motor body in a right-left direction and operable to rotate together with the outboard motor body;

a linearly moving member operable to linearly move to rotate the rotary member;

a first drive source to drive the rotary member by linearly moving the linearly moving member;

a driving force transmission to transmit a driving force to the rotary member; and a second drive source to drive the rotary member via the driving force transmission; and the steering mechanism is switchable between a state in which the rotary member is rotated by the first drive source such that the outboard motor body is steerable within a first steering angle range, and a state in which the rotary member is rotated by the second drive source such that the outboard motor body is steerable within a second steering angle range different from the first steering angle range.

14. An outboard motor comprising:

an outboard motor body; and a steering mechanism to rotate the outboard motor body about a steering shaft; wherein the steering mechanism includes:

a rotary member located in a central portion of the outboard motor body in a right-left direction and operable to rotate together with the outboard motor body;

a rack operable to linearly move to rotate the rotary member;

a first drive source to drive the rotary member by linearly moving the rack;

a driving force transmission to transmit a driving force to the rotary member; and a second drive source to drive the rotary member via the driving force transmission; and the steering mechanism is switchable between a state in which a marine vessel is navigable within a first speed range while the rotary member is rotated by the second drive source to steer the outboard motor body, and a state in which the marine vessel is navigable within a second speed range including a speed range different from the first speed range while the rotary member is rotated by the first drive source to steer the outboard motor body.

15. A marine vessel comprising:

a hull; and an outboard motor attached to a stern of the hull; wherein the outboard motor includes:

an outboard motor body; and a steering mechanism to rotate the outboard motor body about a steering shaft; and the steering mechanism includes:

a pinion located in a central portion of the outboard motor body in a right-left direction and operable to rotate together with the outboard motor body;

a rack operable to linearly move to rotate the pinion;

a first drive source to drive the pinion by linearly moving the rack;

a driving force transmission to transmit a driving force to the pinion; and a second drive source to drive the pinion via the driving force transmission; and the steering mechanism is switchable between a state in which the pinion is rotated by the first drive source such that the outboard motor body is steerable within a first steering angle range, and a state in which the pinion is rotated by the second drive source such that the outboard motor body is steerable within a second steering angle range different from the first steering angle range.

16. The marine vessel according to claim 15, wherein the steering mechanism is switchable between a state in which the pinion is rotated by a hydraulic actuator corresponding to the first drive source such that the outboard motor body is steerable within the first steering angle range, and a state in which the pinion is rotated by an electric motor corresponding to the second drive source such that the outboard motor body is steerable within the second steering angle range having an upper limit larger than an upper limit of the first steering angle range.

17. The marine vessel according to claim 15, further comprising:

a steering controller configured or programmed to control the steering mechanism; wherein the steering controller is configured or programmed to control the first drive source to generate a driving force from the first drive source when the pinion is rotated by the first drive source, and to control the second drive source to generate a driving force from the second drive source when the pinion is rotated by the second drive source.

18. The marine vessel according to claim 15, wherein the steering mechanism is operable to engage the rack with the pinion when the pinion is rotated by the first drive source, and is operable to not engage the rack with the pinion when the pinion is not rotated by the first drive source.

19. The marine vessel according to claim 18, wherein the rack includes teeth to engage with the pinion; and the teeth are in a predetermined range in a longitudinal direction of the rack such that the rack engages with the pinion when the pinion is rotated by the first drive source, and the rack does not engage with the pinion when the pinion is not rotated by the first drive source.

20. The marine vessel according to claim 19, wherein the rack includes:

a toothed portion on a pinion side and including the teeth to engage with the pinion when the pinion is rotated by the first drive source; and a non-toothed portion on the pinion side, adjacent to the toothed portion, and not including the teeth so as to not engage with or contact the pinion when the pinion is not rotated by the first drive source.

* * * * *